US012280977B2

(12) United States Patent
Kishimoto et al.

(10) Patent No.: US 12,280,977 B2
(45) Date of Patent: Apr. 22, 2025

(54) SHEET CONVEYING APPARATUS AND SHEET POST-PROCESSING APPARATUS

(71) Applicant: KYOCERA Document Solutions Inc., Osaka (JP)

(72) Inventors: Tadahisa Kishimoto, Osaka (JP); Koji Murata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 99 days.

(21) Appl. No.: 18/263,959

(22) PCT Filed: Jan. 28, 2022

(86) PCT No.: PCT/JP2022/003294
§ 371 (c)(1),
(2) Date: Aug. 2, 2023

(87) PCT Pub. No.: WO2022/168751
PCT Pub. Date: Aug. 11, 2022

(65) Prior Publication Data

US 2024/0300766 A1 Sep. 12, 2024

(30) Foreign Application Priority Data

Feb. 4, 2021 (JP) ..... 2021-016541
Nov. 17, 2021 (JP) ..... 2021-187067

(51) Int. Cl.
*B65H 45/14* (2006.01)
*B65H 29/60* (2006.01)
(Continued)

(52) U.S. Cl.
CPC ..... *B65H 29/60* (2013.01); *B65H 45/18* (2013.01); *B65H 2301/45* (2013.01); *B65H 2404/1441* (2013.01)

(58) Field of Classification Search
CPC ..... B65H 29/58; B65H 29/60; B65H 29/125; B65H 45/18; B65H 45/12; B65H 45/14;
(Continued)

(56) References Cited

U.S. PATENT DOCUMENTS 6,592,506 B1 * 7/2003 Lyga ..... B65H 29/58 493/434
9,643,813 B2 * 5/2017 Kugimiya ..... B65H 45/18
(Continued)

FOREIGN PATENT DOCUMENTS

JP 2005008337 A * 1/2005
JP 2017-132572 A 8/2017

*Primary Examiner* — Luis A Gonzalez
(74) *Attorney, Agent, or Firm* — Stein IP, LLC

(57) ABSTRACT

A sheet conveying apparatus (20) includes a first sheet conveyance passage (3), a second sheet conveyance passage (5), a pair of feed rollers (3r1), a first pair of conveyance rollers (50), and a contact-release mechanism (60). The second sheet conveyance passage (5) branches from a branch section (31) on the first sheet conveyance passage (3). The first pair of conveyance rollers (50) has a first roller (51) and a second roller (52) and conveys a sheet along the first sheet conveyance passage (3). When, in the branch section (31), a sheet is conveyed from upstream with respect to the sheet conveyance direction in the first sheet conveyance passage (3) toward the second sheet conveyance passage (5), the sheet conveying apparatus (20) makes the contact-release mechanism (60) move the second roller (52) away from the first roller (51) and makes the pair of feed rollers (3r1) convey the sheet.

10 Claims, 4 Drawing Sheets

(51) Int. Cl.
*B65H 45/12* (2006.01)
*B65H 45/18* (2006.01)

(58) Field of Classification Search
CPC ..... B65H 45/148; B65H 2404/1441; B65H 2801/27; B65H 37/06; G03G 2215/00877
See application file for complete search history.

(56) References Cited

U.S. PATENT DOCUMENTS

| | | | | |
|---|---|---|---|---|
| 11,560,286 | B2 * | 1/2023 | Murata | B65H 37/06 |
| 11,926,500 | B2 * | 3/2024 | Kishimoto | B65H 45/162 |
| 2012/0071310 | A1 * | 3/2012 | Satoh | B65H 45/144 493/442 |

* cited by examiner

SHEET CONVEYING APPARATUS AND SHEET POST-PROCESSING APPARATUS

TECHNICAL FIELD

The present invention relates to a sheet conveying apparatus, and to a sheet post-processing apparatus that incorporates a sheet conveying apparatus and that performs post-processing on a sheet having undergone image formation by an image forming apparatus.

Background Art

A sheet conveying apparatus for conveying sheets can include, for example, a plurality of sheet conveyance destinations along with a branch section for changing the sheet conveyance destination. One example of known technology related to such sheet conveying apparatuses is seen in Patent Document 1 identified below.

The known post-processing apparatus disclosed in Patent Document 1 includes an inlet port through which a sheet is introduced into the apparatus, a conveyance passage that extends substantially horizontally from the inlet port to a main tray, another conveyance passage that branches off the first downward to extend in the direction of a belt tray, and a swing claw that is disposed at the bifurcation between the two conveyance passages. The swing claw pivots to switch the sheet conveyance passage.

CITATION LIST

Patent Literature

Patent Document 1: JP-A-2017-132572

SUMMARY OF INVENTION

Technical Problem

According to the know technology mentioned above, when the conveyance passage is switched from the one extending from the inlet port substantially horizontally to the one pointing downward substantially perpendicularly to it, the sheet is conveyed in a bent state. With this configuration, when the sheet conveyed is a cardboard for instance, when it is bent it may develop a stubborn curl. A stubborn curl can degrade the sheet or cause a sheet jam. Such a curl in a sheet can be avoided by giving an increased diameter to the roller disposed inward of the bent sheet, but this can lead to an increased size of the apparatus.

In view of what has been discussed above, an object of the present invention is to provide a sheet conveying apparatus and a sheet post-processing apparatus that are configured to be compact and can still avoid a curl in a sheet when its conveyance direction is switched.

Solution to Problem

To solve the inconveniences mentioned above, according to one aspect of the present invention, a sheet conveying apparatus includes a first sheet conveyance passage, a second sheet conveyance passage, a switch guide, a pair of feed rollers, a first pair of conveyance rollers, a second pair of conveyance rollers, a contact-release mechanism, and a controller. Along the first sheet conveyance passage, a sheet is conveyed. The second sheet conveyance passage branches from a branch section on the first sheet conveyance passage to extend in a direction intersecting the first sheet conveyance passage, and along it the sheet is conveyed. The switch guide switches the conveyance direction of the sheet in the branch section. The pair of feed rollers is disposed upstream of the branch section with respect to the sheet conveyance direction in the first sheet conveyance passage and conveys the sheet toward the branch section. The first pair of conveyance rollers is composed of a first roller and a second roller disposed opposite each other downstream of the pair of feed rollers with respect to the sheet conveyance direction in the first sheet conveyance passage, upstream of the branch section, and conveys the sheet along the first sheet conveyance passage. The second pair of conveyance rollers is composed of the first roller and a third roller disposed opposite each other downstream of the branch section with respect to the sheet conveyance direction in the second sheet conveyance passage, and conveys the sheet having its conveyance direction switched from the first sheet conveyance passage to the second sheet conveyance passage by the switch guide in a direction away from the branch section. The contact-release mechanism moves the second roller closer to and away from the first roller. The controller controls the driving of the pair of feed rollers, the first pair of conveyance rollers, the second pair of conveyance rollers, the switch guide, and the contact-release mechanism. When, in the branch section, the sheet is conveyed from upstream with respect to the sheet conveyance direction in the first sheet conveyance passage toward the second sheet conveyance passage, the controller arranges the switch guide in a predetermined position, makes the contact-release mechanism move the second roller away from the first roller, and makes the pair of feed rollers convey the sheet.

Advantageous Effects of Invention

According to the present invention, a second roller can move apart from a first roller so as to give, in a branch section, a larger radius of curvature to a sheet traveling from upstream with respect to the sheet conveyance direction in a first sheet conveyance passage toward a second sheet conveyance passage. That is, a sheet conveying apparatus is configured to be compact and can still avoid a curl in a sheet when its conveyance direction is switched.

DESCRIPTION OF EMBODIMENTS

An embodiment of the present invention will be described below with reference to the accompanying drawings. The following description is not meant to limit the present invention in any way.

Figure 1:
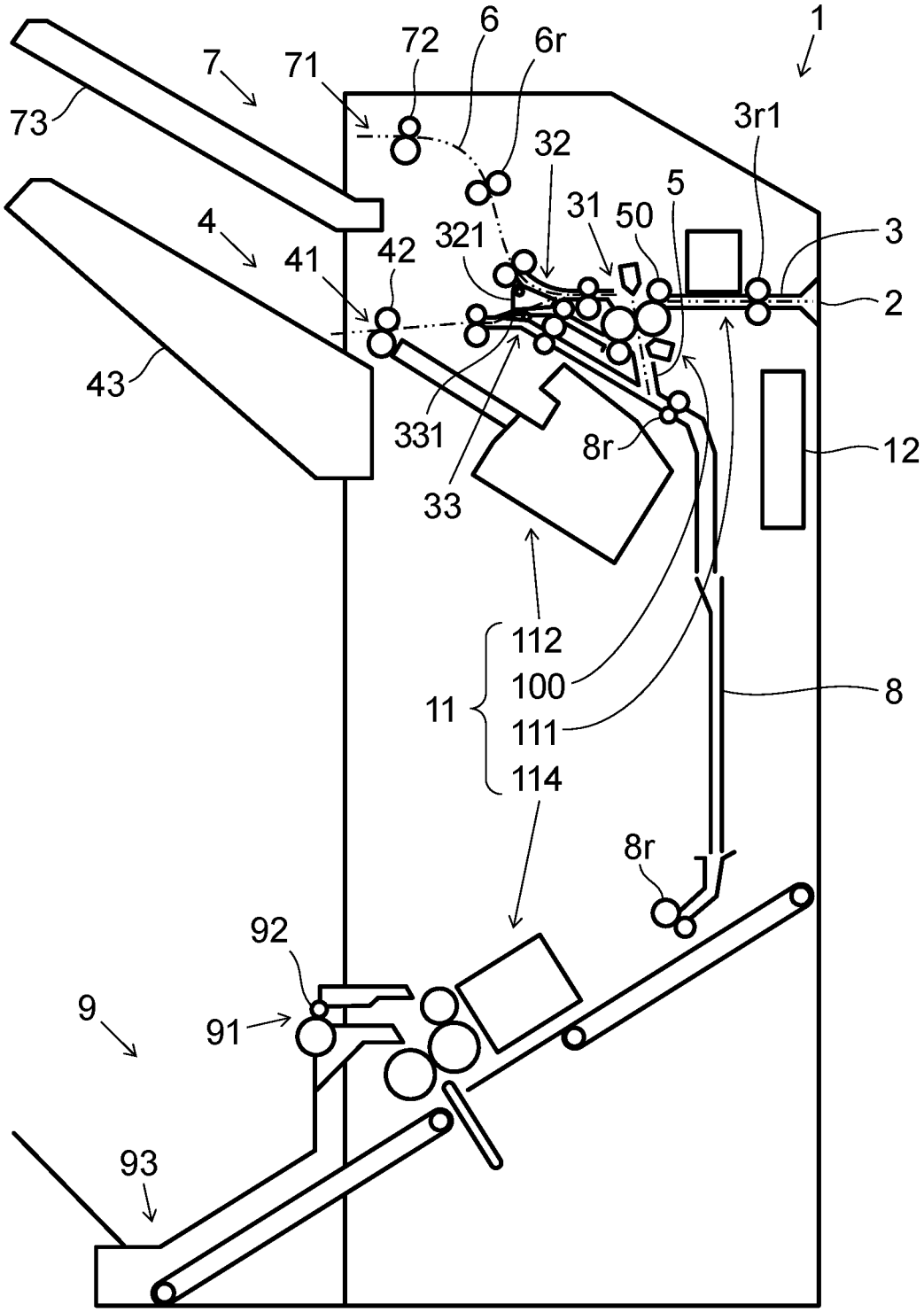
FIG. 1 is a schematic sectional front view showing the construction of a sheet post-processing apparatus according to an embodiment of the present invention.

FIG. 1 is a schematic sectional front view showing the construction of a sheet post-processing apparatus 1 according to the embodiment. The sheet post-processing apparatus 1 is removably coupled to, for example, a side face of an image forming apparatus (not shown). The sheet post-processing apparatus 1 performs post-processing on sheets that have undergone image formation (printing) by the image forming apparatus.

As shown in FIG. 1, the sheet post-processing apparatus 1 includes a sheet inlet port 2, a first sheet conveyance passage 3, a first sheet discharge section 4, a second sheet conveyance passage 5, a third sheet conveyance passage 6, a second sheet discharge section 7, a fourth sheet conveyance passage 8, a third sheet discharge section 9, a post-processing section 11, a post-processing controller 12, and a sheet conveying apparatus 20.

The sheet inlet port 2 is an opening provided in the side face of the sheet post-processing apparatus 1 that faces the image forming apparatus (not shown). A sheet conveyed from the image forming apparatus toward the sheet post-processing apparatus 1 is introduced into the sheet post-processing apparatus 1 through the sheet inlet port 2.

The first sheet conveyance passage 3 extends substantially horizontally from the sheet inlet port 2 to the first sheet discharge section 4, in a direction away from the image forming apparatus (leftward in FIG. 1). In the description here, the direction from the sheet inlet port 2 to the first sheet discharge section 4 is referred to as the sheet conveyance direction in the first sheet conveyance passage 3. The sheet inlet port 2 is located at the upstream end of the first sheet conveyance passage 3 with respect to the sheet conveyance direction.

Along the first sheet conveyance passage 3 are disposed a first pair of conveyance rollers 50 and a plurality of pairs of feed rollers **3*r*1 and 3*r*2 (see FIGS. 1 and 2), which will be described later. The first pair of conveyance rollers 50 and the pairs of feed rollers 3*r*1 an 3*r*2 convey the sheet introduced into the sheet post-processing apparatus 1 through the sheet inlet port 2 along the first sheet conveyance passage 3. The pairs of feed rollers on the first sheet conveyance passage 3 are disposed upstream of a first branch section (branch section) 31 with respect to the sheet conveyance direction in the first sheet conveyance passage 3, and include a pair of feed rollers 3*r*1 (see FIG. 1) that conveys the sheet toward the first branch section 31 and a pair of feed rollers 3*r*2 (see FIG. 2) that is disposed downstream of the first branch section 31**.

The first sheet discharge section 4 is provided on the side face of the sheet post-processing apparatus 1 opposite from its side face facing the image forming apparatus. The first sheet discharge section 4 is disposed at the downstream end of the first sheet conveyance passage 3 with respect to the sheet conveyance direction. The first sheet discharge section 4 includes a first discharge port 41, a first pair of discharge rollers 42, and a first discharge tray 43.

The first discharge port 41 is located at the downstream end of the first sheet conveyance passage 3 with respect to the sheet conveyance direction. The first pair of discharge rollers 42 is disposed at the first discharge port 41. The first discharge tray 43 is located downstream of the first discharge port 41 with respect to the sheet conveyance direction. A sheet that is conveyed along the first sheet conveyance passage 3 and reaches the first discharge port 41 is discharged through the first discharge port 41 onto the first discharge tray 43 by the first pair of discharge rollers 42. The first discharge tray 43 is one of the final discharge locations of sheets having undergone post-processing by the sheet post-processing apparatus 1.

The second sheet conveyance passage 5 branches from the first branch section (branch section) 31 on the first sheet conveyance passage 3. The first branch section 31 is disposed downstream of a perforation section 111 with respect to the sheet conveyance direction in the first sheet conveyance passage 3. The second sheet conveyance passage 5 extends in a direction intersecting the first sheet conveyance passage 3. Specifically, the second sheet conveyance passage 5 extends from the first branch section 31 on the first sheet conveyance passage 3 downward, substantially perpendicularly to the first sheet conveyance passage 3, which extends substantially horizontally. In the description here, the direction away downward from the first branch section 31 is referred to as the sheet conveyance direction in the second sheet conveyance passage 5. The first branch section 31 is located at the upstream end of the second sheet conveyance passage 5 with respect to the sheet conveyance direction. Along the second sheet conveyance passage 5 is disposed a first pair of bending rollers (second pair of conveyance rollers) 103.

The first branch section 31 includes a first switch guide (switch guide) 311. The first switch guide 311 reciprocates between a first position in which it guides a sheet conveyed from the sheet inlet port 2 along the first sheet conveyance passage 3 toward the first discharge port 41 and a second position in which it guides a sheet conveyed from the sheet inlet port 2 along the first sheet conveyance passage 3 toward the second sheet conveyance passage 5. The first switch guide (switch guide) 311 switches the conveyance direction of sheets in the first branch section 31.

The third sheet conveyance passage 6 branches from a second branch section 32 on the first sheet conveyance passage 3 to extend to the second sheet discharge section 7, sideways in a direction away from the image forming apparatus (leftward in FIG. 1) and simultaneously upward. The second branch section 32 is disposed downstream of the first branch section 31 with respect to the sheet conveyance direction in the first sheet conveyance passage 3. In the description here, the direction from the second branch section 32 to the second sheet discharge section 7 is referred to as the sheet conveyance direction in the third sheet conveyance passage 6. The second branch section 32 is located at the upstream end of the third sheet conveyance passage 6 with respect to the sheet conveyance direction. The third sheet conveyance passage 6 has a plurality pairs of feed rollers **6*r* disposed along it, and conveys a sheet that has left the first sheet conveyance passage 3 in the second branch section 32** downstream with respect to the sheet conveyance direction.

The second branch section 32 includes a second switch guide 321. The second switch guide 321 pivots between a first position in which it guides a sheet conveyed from the sheet inlet port 2 along the first sheet conveyance passage 3 to the first discharge port 41 and a second position in which it guides a sheet conveyed from the sheet inlet port 2 along the first sheet conveyance passage 3 to the third sheet conveyance passage 6.

The second sheet discharge section 7 is provided on the side face of the sheet post-processing apparatus 1 opposite from its side face facing the image forming apparatus, above the first sheet discharge section 4. The second sheet discharge section 7 is disposed at the downstream end of the third sheet conveyance passage 6 with respect to the sheet conveyance direction. The second sheet discharge section 7 includes a second discharge port 71, a second pair of discharge rollers 72, and a second discharge tray 73.

The second discharge port 71 is located at the downstream end of the third sheet conveyance passage 6 with respect to the sheet conveyance direction. The second pair of discharge rollers 72 is disposed at the second discharge port 71. The second discharge tray 73 is located downstream of the second discharge port 71 with respect to the sheet conveyance direction. A sheet that is conveyed along the third sheet conveyance passage 6 and reaches the second discharge port 71 is discharged through the second discharge port 71 onto the second discharge tray 73 by the second pair of discharge rollers 72. The second discharge tray 73 is one of the final discharge locations for sheets having undergone post-processing by the sheet post-processing apparatus 1.

The fourth sheet conveyance passage 8 branches from a third branch section 33 on the first sheet conveyance passage 3 to extend downward to the third sheet discharge section 9. In the description here, the direction from the third branch section 33 to the third sheet discharge section 9 is referred to as the sheet conveyance direction in the fourth sheet conveyance passage 8. The third branch section 33 is located downstream of the second branch section 32 with respect to the sheet conveyance direction, and is located at the upstream end of the fourth sheet conveyance passage 8 with respect to the sheet conveyance direction. The fourth sheet conveyance passage 8 has a plurality of pairs of feed rollers 8*r*, and conveys a sheet that has left the first sheet conveyance passage 3 in the third branch section 33 downstream with respect to the sheet conveyance direction.

The third branch section 33 includes a third switch guide 331. The third switch guide 331 pivots between a first position in which it guides a sheet conveyed from the sheet inlet port 2 along the first sheet conveyance passage 3 to the first discharge port 41 and a second position in which it guides a sheet that is conveyed from the sheet inlet port 2 along the first sheet conveyance passage 3 past the third branch section 33 and that is then switched back to the fourth sheet conveyance passage 8.

The third sheet discharge section 9 is provided on the side face of the sheet post-processing apparatus 1 opposite from its side face facing the image forming apparatus, below the first sheet discharge section 4. In other words, the third sheet discharge section 9 is disposed near the bottom of the sheet post-processing apparatus 1. The third sheet discharge section 9 includes a third discharge port 91, a third pair of discharge rollers 92, and a third discharge tray 93.

The third discharge port 91 is located at the downstream end of the fourth sheet conveyance passage 8 with respect to the sheet conveyance direction. The third pair of discharge rollers 92 is disposed at the third discharge port 91. The third discharge tray 93 is located downstream of the third discharge port 91 with respect to the sheet conveyance direction. A sheet that is conveyed along fourth sheet conveyance passage 8 and reaches the third discharge port 91 is discharged through the third discharge port 91 onto the third discharge tray 93 by the third pair of discharge rollers 92. The third discharge tray 93 is one of the final discharge locations for sheets having undergone post-processing by the sheet post-processing apparatus 1.

The post-processing section 11 performs predetermined post-processing on sheets that are introduced into the sheet post-processing apparatus 1 after having undergone image formation by the image forming apparatus. The post-processing section 11 includes the perforation section 111, a stapling section 112, a sheet folding section 100, and a bookbinding section 114.

The perforation section 111 is disposed on the first sheet conveyance passage 3, closely downstream of the sheet inlet port 2. The post-processing section 11 can perforate a sheet conveyed along the first sheet conveyance passage 3 to form punch holes in it.

The stapling section 112 is disposed in a downstream part of the first sheet conveyance passage 3 with respect to the sheet conveyance direction, near the first sheet discharge section 4. The stapling section 112 can staple (bind) a bundle of sheets formed by stacking together a plurality of sheets to bind them together.

The sheet folding section 100 is disposed in the first sheet conveyance passage 3, downstream of the perforation section 111, upstream of the stapling section 112. In other words, the sheet folding section 100 is disposed in a region that includes the first branch section 31. The sheet folding section 100 can fold a single sheet to form a fold line on it. The sheet folding section 100 can apply to a single sheet different types of folding such as double folding, Z-folding, outward triple folding, inward triple folding, and quadruple folding.

The bookbinding section 114 is disposed in a downstream part of the fourth sheet conveyance passage 8 with respect to the sheet conveyance direction, near the third sheet discharge section 9. The bookbinding section 114 can perform, on a bundle of sheets formed by stacking together a plurality of sheets, middle-folding and middle-binding by folding and binding the bundle substantially at its middle with respect to the sheet conveyance direction to produce a booklet.

The post-processing controller 12 includes a CPU, an image processor, a storage, and other electronic circuits and components (none are illustrated). The post-processing controller 12 is connected to a main controller in the image forming apparatus (not shown) such that they can communicate with each other. In response to instructions from the main controller, and based on control programs and data stored in the storage by the CPU, the post-processing controller 12 controls different components of the sheet post-processing apparatus 1 to carry out processes related to the functions of the sheet post-processing apparatus 1. The first sheet conveyance passage 3, the first sheet discharge section 4, the second sheet conveyance passage 5, the third sheet conveyance passage 6, the second sheet discharge section 7, the fourth sheet conveyance passage 8, the third sheet discharge section 9, and the post-processing section 11 individually receive instructions from the post-processing controller 12 and operate in a coordinated manner to perform post-processing on sheets. The functions of the post-processing controller 12 may be assumed by the main controller in the image forming apparatus.

The sheet conveying apparatus 20 is disposed in a region that includes the first sheet conveyance passage 3, the first branch section 31, and the second sheet conveyance passage 5.

Figure 2:
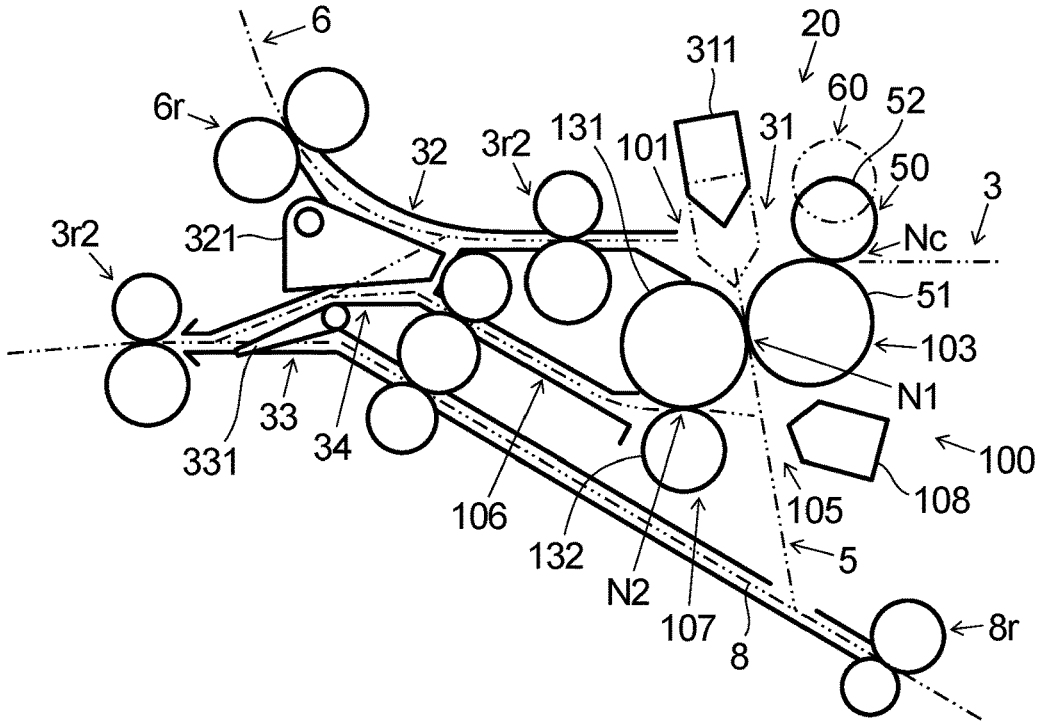
FIG. 2 is a part sectional front view around a sheet conveying apparatus in the sheet post-processing apparatus in FIG. 1.

Next, the configuration and operation of the sheet conveying apparatus 20 will be described in detail. FIG. 2 is a part sectional front view around the sheet conveying apparatus 20 in the sheet post-processing apparatus 1 in FIG. 1. The sheet conveying apparatus 20 includes the first sheet conveyance passage 3, the second sheet conveyance passage 5, the first switch guide (switch guide) 311, the pair of feed rollers 3r1, the first pair of conveyance rollers 50, the first pair of folding rollers (second pair of conveyance rollers) 103, a contact-release mechanism 60, and the sheet folding section 100. In this embodiment, the sheet conveying apparatus 20 is driven by the post-processing controller 12; instead the sheet conveying apparatus 20 may include a controller of its own.

The first pair of conveyance rollers 50 is disposed downstream of the pair of feed rollers 3r1 with respect to the sheet conveyance direction in the first sheet conveyance passage 3, upstream of the first branch section 31. The first pair of conveyance rollers 50 conveys a sheet along the first sheet conveyance passage 3.

The first pair of conveyance rollers 50 is composed of a first roller 51 and a second roller 52 disposed opposite each other. In this embodiment, the first roller 51 is disposed below the first sheet conveyance passage 3, next to the second sheet conveyance passage 5. The second roller 52 is disposed above the first sheet conveyance passage 3, away from the second sheet conveyance passage 5 across the first sheet conveyance passage 3. The first pair of conveyance rollers 50 has the second roller 52 urged by the contact-release mechanism 60 toward the first roller 51 so that the two rollers make contact with each other to form a conveyance nip Nc.

Figure 5:
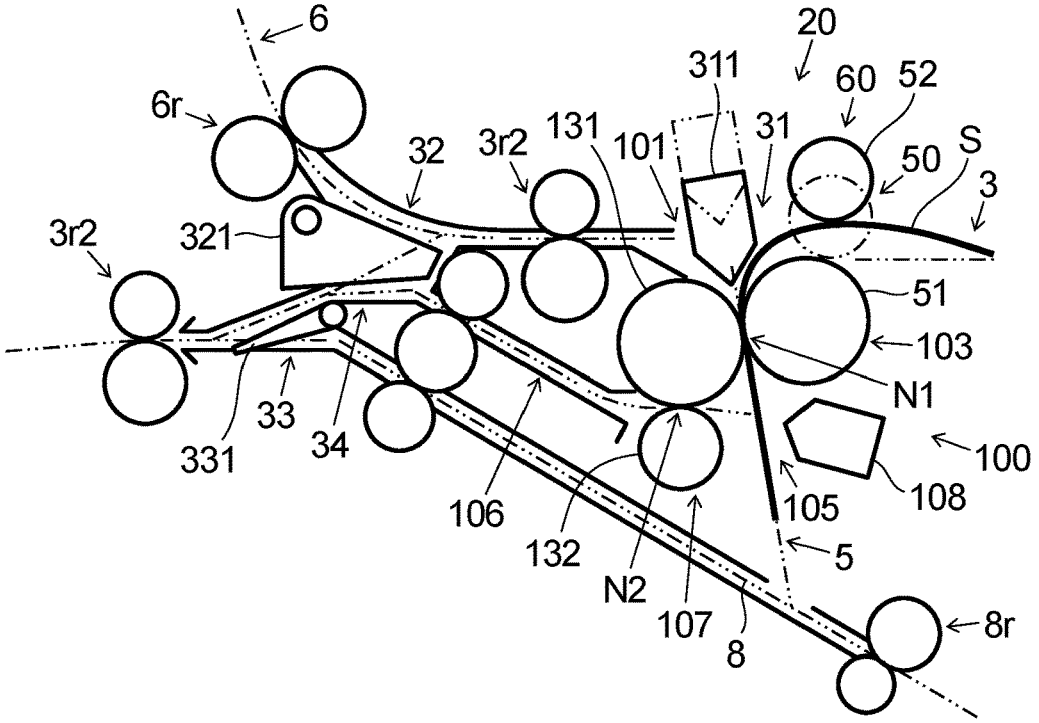
FIG. 5 is a sectional front view around the sheet conveying apparatus in FIG. 2, showing how a sheet is conveyed from upstream with respect to the sheet conveyance direction in the a sheet conveyance passage toward a second sheet conveyance passage.

The first roller 51 is located inward of a sheet S that is bent in the first branch section 31 from the first sheet conveyance passage 3 toward the second sheet conveyance passage 5 (see FIG. 5). The second roller 52 is located outward of the sheet S that is bent in the first branch section 31 from the first sheet conveyance passage 3 toward the second sheet conveyance passage 5 (see FIG. 5). That is, the first branch section 31 is formed in such a shape that the sheet S is conveyed from the first sheet conveyance passage 3 toward the second sheet conveyance passage 5 in a state bent to fit along the circumferential face of the first roller 51.

The first pair of folding rollers 103 is disposed downstream of the first branch section 31 with respect to the sheet conveyance direction in the second sheet conveyance passage 5. The first pair of folding rollers 103 is composed of the first roller 51 and a first folding roller (third roller) 131 disposed opposite each other. The first pair of folding rollers 103 conveys the sheet having its conveyance direction switched from the first sheet conveyance passage 3 to the second sheet conveyance passage 5 by the first switch guide 311 in a direction away from the first branch section 31.

Figure 3:
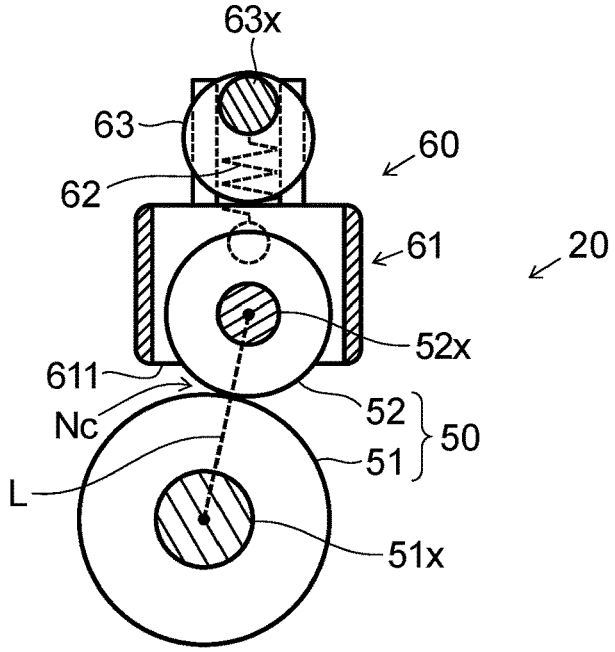
FIG. 3 is a sectional front view around a first pair of conveyance rollers in the sheet conveying apparatus in FIG. 2, showing the first pair of conveyance rollers forming a conveyance nip.
Figure 4:
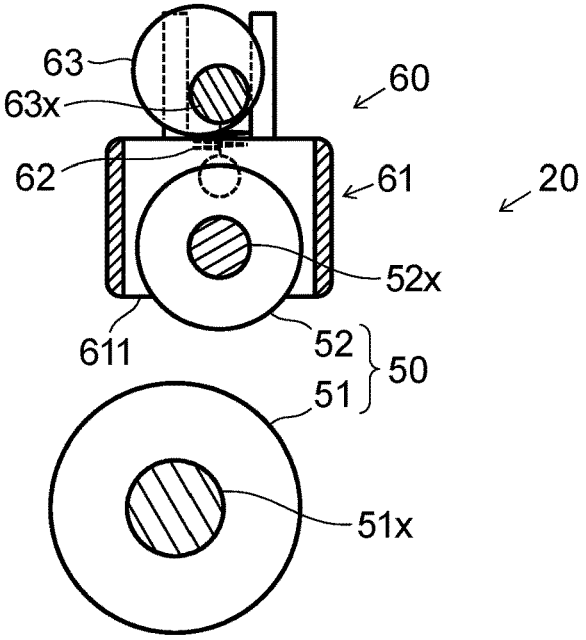
FIG. 4 is a sectional front view around the first pair of conveyance rollers in the sheet conveying apparatus in FIG. 2, showing the two rollers of the first pair of conveyance rollers moved apart from each other.

The contact-release mechanism 60 is disposed next to the second roller 52. FIG. 3 is a sectional front view around the first pair of conveyance rollers 50 in the sheet conveying apparatus 20 in FIG. 2, showing the first pair of conveyance rollers 50 forming the conveyance nip Nc. FIG. 4 is a sectional front view around the first pair of conveyance rollers 50 in the sheet conveying apparatus 20 in FIG. 2, showing the two rollers of the first pair of conveyance rollers 50 moved apart from each other. The contact-release mechanism 60 includes a holder 61, an urging member 62, and an eccentric cam 63.

The holder 61 is formed, for example, in a box shape extending along the sheet width direction orthogonal to the sheet conveyance direction. The holder 61 houses the second roller 52 inside it and rotatably holds the second roller 52. Specifically, the holder 61 rotatably supports opposite end parts of a shaft portion 52*x* of the second roller 52 in its axial direction. A lower part of the circumferential face of the second roller 52 is exposed downward through a bottom opening 611 in the holder 61.

Relative to the first pair of conveyance rollers 50, the second roller 52 is located upstream of the first roller 51 with respect to the sheet conveyance direction in the first sheet conveyance passage 3. In other words, as seen from one end along the sheet width direction as shown in FIG. 3, the line L connecting between the axis of a shaft portion 51*x* of the first roller 51 and the axis of the shaft portion 52*x* of the second roller 52 is inclined, as it extends from the first roller 51 (lower) to the second roller 52 (upper), upstream (rightward in FIG. 3) with respect to the sheet conveyance direction in the first sheet conveyance passage 3.

The holder 61 is supported so as to be movable in the up-down direction, for example, by a guide member (not shown) provided on the frame of the sheet post-processing apparatus 1. That is, the second roller 52 is movable in the up-down direction together with the holder 61.

The urging member 62 is coupled between the holder 61 and a shaft portion 63*x* of the eccentric cam 63. The urging member 62 is configured, for example, as a tension spring, and urges the holder 61 in a direction in which it moves closer to the shaft portion 63*x* of the eccentric cam 63, that is, upward in FIGS. 3 and 4. In other words, the urging member 62 urges the holder 61 in such a direction that the second roller 52 moves away from the first roller 51.

The eccentric cam 63 is fixed to its shaft portion 63*x*, which, for example, extends along the sheet width direction. The shaft portion 63*x* of the eccentric cam 63 is, for example, rotatably supported on the frame of the sheet post-processing apparatus 1. The eccentric cam 63 together with its shaft portion 63*x* rotates about the axis of the shaft portion 63*x*. The shaft portion 63*x* is coupled to a driving source (not shown) such as a motor and is rotated by the driving source.

The eccentric cam 63 makes contact with the holder 61. The eccentric cam 63 rotates against the urging force of the urging member 62 to move the holder 61 in such a direction that the second roller 52 moves closer to the first roller 51, that is, downward in FIGS. 3 and 4. The upper and lower limit positions of the holder 61 are sensed by, for example, an optical sensor (not shown) or the like.

The contact-release mechanism 60 can move the second roller 52 in the up-down direction. In other words, the contact-release mechanism 60 moves the first and second rollers 51 and 52 constituting the pair of first conveyance rollers 50 closer to and away from each other. The driving of the contact-release mechanism 60 is controlled by the post-processing controller 12.

FIG. 5 is a sectional front view around the sheet conveying apparatus 20 in FIG. 2, showing how a sheet S is conveyed from upstream with respect to the sheet conveyance direction in the first sheet conveyance passage 3 toward the second sheet conveyance passage 5. In the sheet conveying apparatus 20, when, in the first branch section 31, a sheet S is conveyed from upstream with respect to the sheet conveyance direction in the first sheet conveyance passage 3 toward the second sheet conveyance passage 5, the post-processing controller 12 arranges the first switch guide 311 in the second position (predetermined position), makes the contact-release mechanism 60 move the second roller 52 apart from the first roller 51, and makes the pair of feed rollers 3r1 (see FIG. 1) convey the sheet.

Specifically, in this embodiment, on receiving an instruction to convey a sheet S to the second sheet conveyance passage 5, the post-processing controller 12 makes the contact-release mechanism 60 move the second roller 52 apart from the first roller 51.

When, in the first branch section 31, the sheet S is conveyed from upstream with respect to the sheet conveyance direction in the first sheet conveyance passage 3 toward the second sheet conveyance passage 5, the post-processing controller 12 holds and conveys the sheet with only the pair of feed rollers 3*r*1 (see FIG. 1) located upstream with respect to the sheet conveyance direction in the first branch section 31.

With this configuration, the second roller 52 can move apart from the first roller 51, and this helps increase the radius of curvature of the sheet S traveling, in the first branch section 31, from upstream with respect to the sheet conveyance direction in the first sheet conveyance passage 3 toward the second sheet conveyance passage 5. It is then unnecessary to increase the diameter of the first roller 51 disposed inward of the bent sheet in order to avoid a curl in the sheet S. It is thus possible to prevent an increase in the size of the sheet conveying apparatus 20 along the sheet conveyance direction in the first sheet conveyance passage 3, that is, the size of the sheet conveying apparatus 20 in the horizontal, left-right direction in FIGS. 1 and 2. That is, the sheet conveying apparatus 20 is configured to be compact and can still avoid a curl in a sheet S when its conveyance direction is switched.

Specifically, when, in the first branch section 31, the sheet S is conveyed from upstream with respect to the sheet conveyance direction in the first sheet conveyance passage 3 toward the second sheet conveyance passage 5, the post-processing controller 12 makes the contact-release mechanism 60 move the second roller 52 apart from the first roller 51 after the downstream end (leading end) of the sheet with respect to the sheet conveyance direction in the second sheet conveyance passage 5 passes a first folding nip N1, which will be described later, and the upstream end (trailing end) of the sheet reaches the first folding nip N1. With this configuration, the downstream end (leading end) of the sheet is held by the first pair of folding rollers 103, and this prevents sagging, displacement, or the like of the sheet. This leads to enhanced sheet conveyance performance.

Moreover, in the configuration described above, the contact-release mechanism 60 includes the holder 61, the urging member 62, and the eccentric cam 63. With this configuration, it is possible to move the first and second rollers 51 and 52 close to and away from each other in a direction (up-down direction) intersecting the first sheet conveyance passage 3. This helps reduce the size of the sheet conveying apparatus 20 along the sheet conveyance direction in the first sheet conveyance passage 3.

The sheet folding section 100 is disposed in a region that includes the first branch section 31. The sheet folding section 100 includes, as described previously, the first pair of conveyance rollers 50, the first pair of folding rollers 103, and the first switch guide 311. As shown in FIG. 2, the sheet folding section 100 further includes a first folding section 101, a second folding section 105, a folding conveyance passage 106, a second pair of folding rollers 107, and a folding guide 108.

The first folding section 101 is disposed in the first branch section 31. In other words, the first folding section 101 is located downstream, with respect to the sheet conveyance direction, of where the perforation section 111 (see FIG. 1) is disposed on first sheet conveyance passage 3, upstream of the second branch section 32 with respect to the sheet conveyance direction.

The first pair of folding rollers 103 is disposed in the first folding section 101, on the second sheet conveyance passage 5. Specifically, the first pair of folding rollers 103 is disposed next to the first branch section 31 on the second sheet conveyance passage 5.

The first pair of folding rollers 103 forms a first folding nip N1. Specifically, the first pair of folding rollers 103 has one of the first roller (second folding roller) 51 and the first folding roller (third roller) 131 urged toward and brought into contact with the other to form the first folding nip N1. The first pair of folding rollers 103 folds the sheet along first sheet conveyance passage 3 and then conveys it to the second sheet conveyance passage 5. The sheet having entered the second sheet conveyance passage 5 passes the first folding nip N1 and is conveyed to below the first pair of folding rollers 103.

The first switch guide (switch guide) 311 is disposed in the first branch section 31, that is, in the first folding section 101, opposite the first folding nip N1. Specifically, the first switch guide 311 is disposed upstream of the first folding nip N1 with respect to the sheet conveyance direction in the second sheet conveyance passage 5, that is, above the first folding nip N1 in FIG. 2. When the sheet is not folded, the first switch guide 311 is retracted off the first sheet conveyance passage 3 in a direction away from the first folding nip N1, that is, to a first position above the first sheet conveyance passage 3 in FIG. 2. Thus, the sheet passing along the first sheet conveyance passage 3 does not make contact with the first switch guide 311.

The first switch guide 311 is connected to a driving mechanism (not shown), and can reciprocate in directions approaching and receding from the first folding nip N1. When a sheet conveyed along the first sheet conveyance passage 3 is conveyed toward the second sheet conveyance passage 5, the first switch guide 311 is moved in a direction approaching the first folding nip N1 to be arranged in a second position (predetermined position) (see FIG. 5). Thus, the first switch guide 311 is a folding blade that guides the sheet conveyed along the first sheet conveyance passage 3 to the first folding nip N1. The driving of the first switch guide 311 is controlled by the post-processing controller 12.

The second folding section 105 is disposed on the second sheet conveyance passage 5. Specifically, the second folding section 105 is located downstream, with respect to the sheet conveyance direction, of where the first pair of folding rollers 103 is disposed on the second sheet conveyance passage 5, below the first folding nip N1.

The folding conveyance passage 106 branches from the second folding section 105 on the second sheet conveyance passage 5 to extend in a direction intersecting the second sheet conveyance passage 5. The folding conveyance passage 106 extends from the second folding section 105 toward the side face of the sheet post-processing apparatus 1 where the first sheet discharge unit 4 is provided, that is, leftward in FIG. 2.

In other words, the folding conveyance passage 106 extends generally in the same direction as the first sheet conveyance passage 3 does.

The first sheet conveyance passage 3 includes a junction section 34 located downstream of the second branch section 32 with respect to the sheet conveyance direction. In the junction section 34, the folding conveyance passage 106 joins the first sheet conveyance passage 3. In other words, the junction section 34 is located downstream of the second branch section 32 on the first sheet conveyance passage 3 with respect to the sheet conveyance direction, and is where the sheet S rejoins it after having been folded in the sheet folding section 100.

The second pair of folding rollers 107 is disposed in the second folding section 105, on the folding conveyance passage 106. The second pair of folding rollers 107 is composed of the first folding roller 131 and a third folding roller 132. The second pair of folding rollers 107 has one of the first and third rollers 131 and 132 urged toward and brought into contact with the other to form a second folding nip N2. The sheet having entered the folding conveyance passage 106 passes the second folding nip N2 and is conveyed toward the junction section 34, that is, to the left of the second pair of folding rollers 107 in FIG. 2.

The folding guide 108 is disposed in the second folding section 105, opposite the second folding nip N2. Specifically, the folding guide 108 is disposed upstream of the second folding nip N2 with respect to the sheet conveyance direction in the folding conveyance passage 106, that is, to the right of the second folding nip N2 in FIG. 2. When the sheet is not folded, the folding guide 108 is retracted off the second sheet conveyance passage 5 in a direction away from the second folding nip N2, that is, to the right of the second sheet conveyance passage 5 in FIG. 2. Thus, the sheet passing along the second sheet conveyance passage 5 does not make contact with the folding guide 108.

The folding guide 108 is connected to a driving mechanism (not shown) and can reciprocate in directions approaching and receding from the second folding nip N2. When a sheet conveyed along the second sheet conveyance passage 5 is conveyed toward the folding conveyance passage 106, the folding guide 108 is moved in a direction approaching the second folding nip N2 to be arranged at a predetermined position. Thus, the folding guide 108 guides the sheet conveyed along the second sheet conveyance passage 5 to the second folding nip N2. The driving of the folding guide 108 is controlled by the post-processing controller 12.

With this configuration, when a sheet to be folded in the sheet folding section 100 is conveyed, in the first branch section 31, from upstream with respect to the sheet conveyance direction in the first sheet conveyance passage 3 toward the second sheet conveyance passage 5, the contact-release mechanism 60 can move the second roller 52 apart from the first roller 51. Thus, when the sheet is folded, the sheet conveying apparatus 20 can avoid a curl in the sheet.

In the configuration described above, the sheet folding section 100 includes the first pair of folding rollers 103 that forms the first folding nip N1. The first switch guide 311 is a folding blade that guides the sheet conveyed along the first sheet conveyance passage 3 to the first folding nip N1. With this configuration, the first switch guide 311 can be shared between when, in the first branch section 31, the sheet is conveyed from upstream with respect to the sheet conveyance direction in the first sheet conveyance passage 3 toward the second sheet conveyance passage 5 and when, in the first folding section 101 (first branch section 31), the sheet is folded. This helps reduce the size of the sheet conveying apparatus 20.

The first pair of folding rollers 103 forms the first folding nip N1 with the first folding roller 131 and the first roller 51. With this configuration, the first roller 51 can be shared between the first pair of conveyance rollers 50 and the first pair of folding rollers 103. This helps reduce the size of the sheet conveying apparatus 20.

Figure 6:
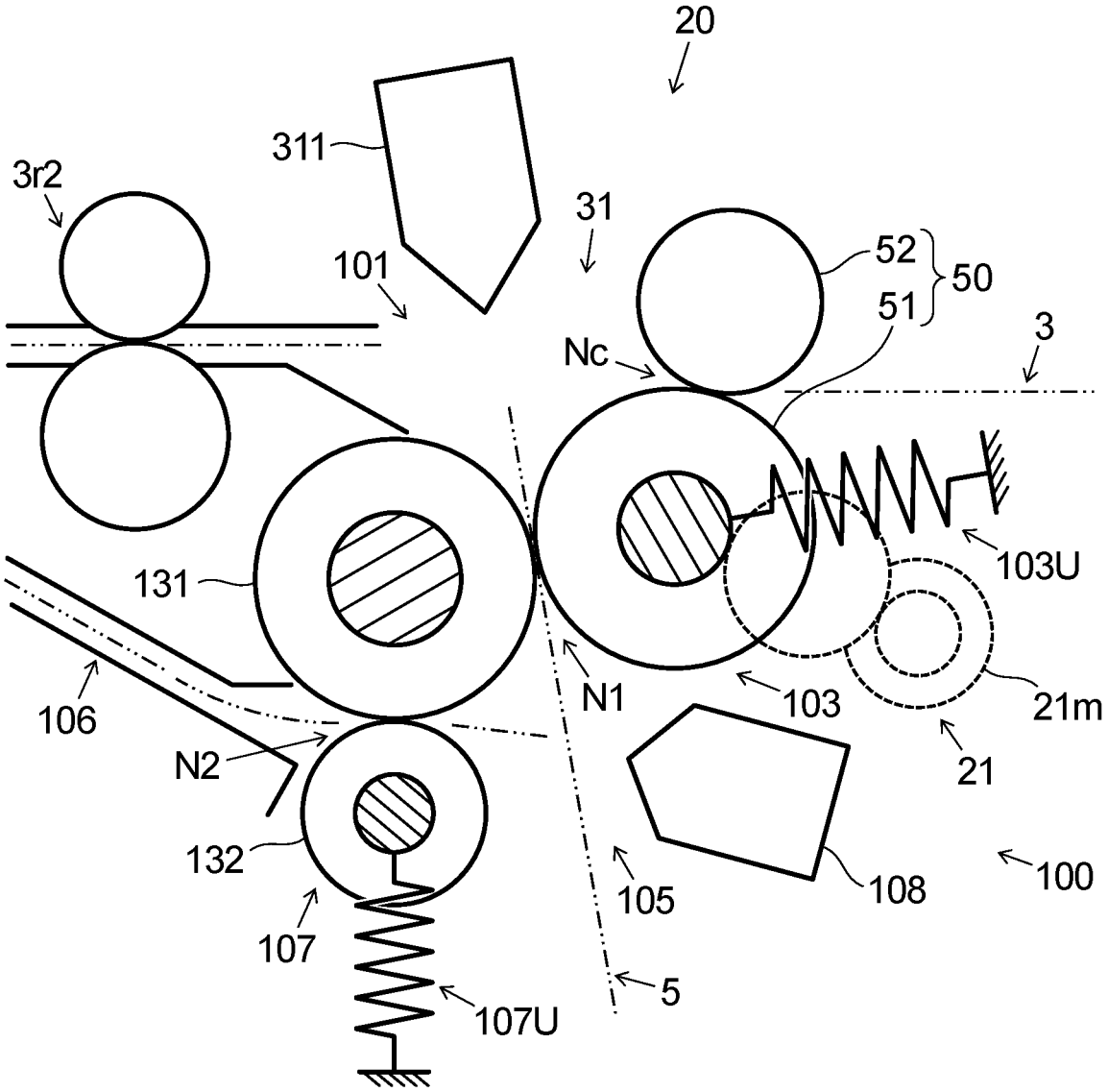
FIG. 6 is a part sectional front view of a sheet folding section in FIG. 2.

FIG. 6 is a part sectional front view of the sheet folding section 100 in FIG. 2. The sheet folding section 100 includes the first pair of folding rollers 103 and the second pair of folding rollers 107.

In this embodiment, the sheet folding section 100 further includes a first urging mechanism 103U and a second urging mechanism 107U. In this embodiment, the first folding roller 131 is supported on the body or the like of the sheet post-processing apparatus 1 so as not to be movable in a radial direction (parallel to the plane of FIG. 6) orthogonal to the axial direction.

The first urging mechanism 103U is disposed next to the first roller 51. The first urging mechanism 103U includes an urging member such as a spring and urges the first roller 51 toward the first folding roller 131. The first roller 51 is supported so as to be movable in a radial direction orthogonal to the axial direction. The first roller 51, by being urged toward and brought into contact with the first folding roller 131, forms the first folding nip N1.

With this configuration, using the first pair of folding rollers 103, it is possible to carry out sheet conveyance and sheet folding suitably.

The sheet conveying apparatus 20 further includes a driver 21 including a motor 21*m*. The driver 21 drives the first roller 51 to rotate. With this configuration, the second roller 52 and the first folding roller 131, which make contact with the first roller 51, can be rotated individually. It is thus easy to carry out sheet conveyance along the first sheet conveyance passage 3 as well as sheet conveyance along the second sheet conveyance passage 5 and sheet folding by the first pair of folding rollers 103.

The second urging mechanism 107U is disposed next to the third folding roller 132. The second urging mechanism 107U includes, for example, an urging member such as a spring and urges the third folding roller 132 toward the first folding roller 131. The third folding roller 132 is supported so as to be movable in a radial direction orthogonal to the axial direction. The second pair of folding rollers 107 is composed of the first folding roller 131 and the third folding roller 132, the latter being urged toward and brought into contact with the former to form the second folding nip N2. The second pair of folding rollers 107 folds the sheet along the second sheet conveyance passage 5 and conveys it to the folding conveyance passage 106.

For improved folding accuracy in the first and second pairs of folding rollers 103 and 107, it is necessary that the first folding roller 131, which is shared among them, be unmovable in a radial direction. The first folding roller 131 is located downstream of the first roller 51 with respect to the first sheet conveyance passage 3. Accordingly, in the configuration described above, the first and second rollers 51 and 52 constitute a pair of rollers that conveys a sheet along the first sheet conveyance passage 3, and this helps prevent too large a distance between the pairs of rollers upstream of the first branch section 31 on the first sheet conveyance passage 3. This eliminates the need for more pairs of rollers than necessary, and helps reduce the number of components of the sheet conveying apparatus 20 and its size.

Moreover, during sheet conveyance and sheet folding, the first folding roller 131, the first roller (second folding roller) 51, and the third folding roller 132 rotate only in one direction. Specifically, in this embodiment, the first folding roller 131 and the first roller 51 rotate only in the direction in which they convey the sheet S along the second sheet conveyance passage 5 in a direction away from the first sheet conveyance passage 3 (downward in FIG. 6). In this embodiment, the first and third folding rollers 131 and 132 rotate only in the direction in which they convey the sheet S along the folding conveyance passage 106 in a direction away from the second sheet conveyance passage 5 (leftward in FIG. 6).

With this configuration, the sheet conveying apparatus 20 does not require complicated control and can be implemented with a simple configuration. It is thus possible to reduce the number of components and the size of the sheet conveying apparatus 20.

Provided with the sheet conveying apparatus 20 configured as described above, the sheet post-processing apparatus 1 is configured to be compact and can still avoid a curl in a sheet S when its conveyance direction is switched.

While the present invention has been described by way of embodiments, this is in no way meant to limit the scope of the invention, which can be implemented with any modifications made without departure from the spirit of the invention.

INDUSTRIAL APPLICABILITY

The present invention is useful in a sheet conveying apparatus and in a sheet post-processing apparatus incorporating a sheet conveying apparatus for use with an image forming apparatus.

The invention claimed is:

1. A sheet conveying apparatus, comprising:

a first sheet conveyance passage along which a sheet is conveyed;

a second sheet conveyance passage that branches from a branch section on the first sheet conveyance passage to extend in a direction intersecting the first sheet conveyance passage and along which the sheet is conveyed;

a switch guide that switches a conveyance direction of the sheet in the branch section;

a pair of feed rollers that is disposed upstream of the branch section with respect to a sheet conveyance direction in the first sheet conveyance passage and that conveys the sheet toward the branch section;

a first pair of conveyance rollers that is composed of a first roller and a second roller disposed opposite each other downstream of the pair of feed rollers with respect to the sheet conveyance direction in the first sheet conveyance passage, upstream of the branch section, and that conveys the sheet along the first sheet conveyance passage;

a second pair of conveyance rollers that is composed of the first roller and a third roller disposed opposite each other downstream of the branch section with respect to a sheet conveyance direction in the second sheet conveyance passage and that conveys the sheet having the conveyance direction thereof switched from the first sheet conveyance passage to the second sheet conveyance passage by the switch guide in a direction away from the branch section;

a contact-release mechanism that moves the second roller closer to and away from the first roller; and a controller that controls driving of the pair of feed rollers, the first pair of conveyance rollers, the second pair of conveyance rollers, the switch guide, and the contact-release mechanism, wherein when, in the branch section, the sheet is conveyed from upstream with respect to the sheet conveyance direction in the first sheet conveyance passage toward the second sheet conveyance passage, the controller arranges the switch guide in a predetermined position, makes the contact-release mechanism move the second roller away from the first roller, and makes the pair of feed rollers convey the sheet.

2. The sheet conveying apparatus according to claim 1, wherein when, in the branch section, the sheet is conveyed from upstream with respect to the sheet conveyance direction in the first sheet conveyance passage toward the second sheet conveyance passage, the controller makes the contact-release mechanism move the second roller away from the first roller after a downstream end of the sheet with respect to the sheet conveyance direction in the second sheet conveyance passage passes across a nip in the second pair of conveyance rollers and an upstream end of the sheet reaches the nip.

3. The sheet conveying apparatus according to claim 1, further comprising:

a sheet folding section that is disposed in a region including the branch section and that folds the sheet, the sheet folding section including the first pair of conveyance rollers, the second pair of conveyance rollers, and the switch guide, wherein the second pair of conveyance rollers is a first pair of folding rollers that forms a first folding nip and that folds the sheet along the first sheet conveyance passage and then conveys the sheet to the second sheet conveyance passage, and the switch guide is a folding blade that is disposed in the branch section, opposite the first folding nip, and that guides the sheet conveyed along the first sheet conveyance passage to the first folding nip.

4. The sheet conveying apparatus according to claim 3, wherein the first pair of folding rollers forms the first folding nip as a result of a first folding roller, which is the third roller, and a second folding roller, which is the first roller, making contact with each other.

5. The sheet conveying apparatus according to claim 1, wherein the contact-release mechanism includes:

a holder that rotatably holds the second roller;

an urging member that urges the holder in such a direction that the second roller moves away from the first roller; and an eccentric cam that makes contact with the holder and that rotates against an urging force of the urging member to move the holder in such a direction that the second roller moves closer to the first roller.

6. The sheet conveying apparatus according to claim 4, wherein the first folding roller is supported so as not to be movable in a radial direction orthogonal to an axial direction, and the second folding roller is supported so as to be movable in the radial direction and forms the first folding nip by being urged toward and brought into contact with the first folding roller.

7. The sheet conveying apparatus according to claim 6, further comprising:

a driver that drives the second folding roller to rotate.

8. The sheet conveying apparatus according to claim 6, further comprising:

a folding conveyance passage that branches off the second sheet conveyance passage to extend in a direction intersecting the second sheet conveyance passage, wherein the sheet folding section includes a second pair of folding rollers that forms a second folding nip and that folds the sheet along the second sheet conveyance passage and then conveys the sheet to the folding conveyance passage, and the second pair of folding rollers is composed of the first folding roller and a third folding roller that forms the second folding nip by being urged toward and brought into contact with the first folding roller.

9. The sheet conveying apparatus according to claim 6, wherein during sheet conveyance and sheet folding, the first, second, and third folding rollers rotate only in one direction.

10. A sheet post-processing apparatus comprising the sheet conveying apparatus according to claim 1.

* * * * *